US006018585A

United States Patent [19]

Akino et al.

[11] Patent Number: 6,018,585

[45] Date of Patent: Jan. 25, 2000

[54] WATERPROOF MICROPHONE

[75] Inventors: Hiroshi Akino; Satoshi Uchimura, both of Sagamihara, Japan

[73] Assignee: Kabushiki Kaisha Audio-Technica, Tokyo, Japan

[21] Appl. No.: 08/957,105

[22] Filed: Oct. 24, 1997

[51] Int. Cl.[7] ..... H04R 25/00

[52] U.S. Cl. ..... 381/355; 381/355; 381/189; 128/201.19

[58] Field of Search ..... 128/201.19; 381/355, 381/345, 391, 189, 410, 344, 334

[56] References Cited

U.S. PATENT DOCUMENTS

| | | | |
|---|---|---|---|
| 1,901,065 | 3/1933 | Spotts | 381/359 |
| 2,556,168 | 6/1951 | Cragg et al. | 381/359 |
| 3,642,558 | 2/1972 | Gorike | 161/5 |
| 4,065,648 | 12/1977 | Cvetko et al. | 179/178 |
| 4,807,294 | 2/1989 | Iwata et al. | 381/190 |
| 5,828,761 | 10/1998 | Langer | 381/91 |

FOREIGN PATENT DOCUMENTS 9-205693 8/1997 Japan .

*Primary Examiner*—Paul Loomis
*Assistant Examiner*—Dionne N. Harvey
*Attorney, Agent, or Firm*—Welsh & Katz, Ltd.

[57] ABSTRACT

A waterproof microphone according to the present invention includes a case; an acoustic terminal unit having a front acoustic terminal and a rear acoustic terminal to be accommodated in the case through a unit holder and a unit case; waterproof films in the case for covering the front acoustic terminal and the rear acoustic terminal of the acoustic terminal unit, respectively; the waterproof films being deformed at a predetermined water pressure; and restraining means provided between said acoustic terminal unit and said waterproof films for restraining the deformation of each said waterproof films, so that the thickness and shape of the waterproof films can be each adjusted.

12 Claims, 1 Drawing Sheet

WATERPROOF MICROPHONE

FIELD OF THE INVENTION

The present invention relates to a waterproof microphone capable enhancing various properties while maintaining a water resistance.

BACKGROUND OF THE INVENTION

In a waterproof microphone generally used, often, an acoustic terminal unit is covered with a waterproof film, for example, such as a plastic film, rubber, etc., on the supposition that a user erroneously drops it into water.

In this waterproof film is set to an appropriate shape and thickness so that it is not broken even if a fixed water pressure exerts thereto and returned to its original shape.

In the thus set waterproof microphone, a sound wave having passed transmitted the waterproof film arrives at the acoustic terminal unit.

Accordingly, for enhancing various properties such as the sensitivity, frequency responsiveness, etc. of the waterproof microphone, it is necessary to make the waterproof film as thin as possible.

SUMMARY OF THE INVENTION

An object of the present invention is fulfilled with such the needs as described, and is to provide a waterproof microphone capable of maintaining a water resistance even if a thickness and a shape of a waterproof film is suitably set and of enhancing various properties.

The waterproof microphone according to the present invention comprises a case, an acoustic terminal unit encased into the case through a unit holder and a unit case, a waterproof film provided so as to cover a front acoustic terminal and a rear acoustic terminal of the acoustic terminal unit, and a control means provided so as to control deformation of the waterproof film between the acoustic terminal unit and the waterproof film.

In this case, as the control means, there can be employed the construction in which a rod-like member, a mesh or the like is arranged parallel with the waterproof film. These rod-like member, the mesh or the like may be arranged at a suitable position so that they come in contact with the waterproof film when the waterproof film is deformed due to the fixed water pressure to thereby control the deformation of the waterproof film uniformly.

With the constitution as described, since the deformation of the waterproof film is controlled uniformly by the control means, even if the user should drop the microphone into water erroneously, the waterproof film is not broken.

Accordingly, the shape, the thickness or the like of the waterproof film can be suitably set whereby various properties such as the sensitivity, the frequency responsiveness, etc. can be enhanced.

Further, in the case where the control means comprises the mesh arranged parallel with the waterproof film, the mesh acts as a diaphragm having a low acoustic impedance in normal use, thus not impeding various properties.

Further, in this waterproof microphone, the waterproof film comes in close contact with the mesh to form a number of small diaphragms which absorb sound in water.

DESCRIPTION OF THE PREFERRED EMBODIMENT

One embodiment of the waterproof microphone according to the present invention will be explained hereinafter with reference to the drawings.

Figure 1:
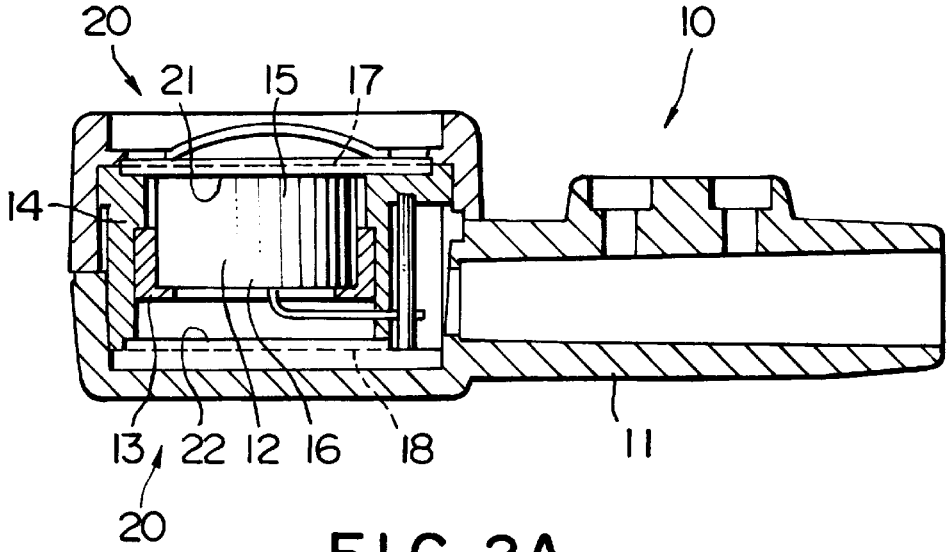
FIG. 1 is a sectional view showing one embodiment of a waterproof microphone according to the present invention.

Referring to FIG. 1, a waterproof microphone 10 is used for a head-set which is used, for example, for a water aerobics.

The waterproof microphone 10 includes a case 11 connected to a stem of the head-set (not shown), and an acoustic terminal unit 12 encased in the case 11.

The acoustic terminal unit 12 is supported on the case through a unit holder 13 and a unit case 14. A front acoustic terminal 15 and a rear acoustic terminal 16 are covered with waterproof films 17 and 18, respectively.

The waterproof films 17 and 18 are formed into a predetermined shape by PET (polyethyleneterephtalate) having a thickness of 4 $\mu$m. Even if the waterproof microphone 10 is submerged into a predetermined depth, these waterproof films 17 and 18 are not deformed and broken due to the water pressure, and are restored to their original shape when water pressure is released.

A control means 20 for controlling deformation of the waterproof films 17 and 18 is provided between the acoustic terminal unit 12 and the waterproof films 17, 18.

The control means 20 comprises stainless steel meshes 21, 22 arranged parallel with the waterproof films 17, 18.

The stainless steel meshes 21, 22 have a wire diameter of, for example, 0.1 mm, #100, and are arranged at a suitable position so that they come in contact with the waterproof films 17, 18 when the latter are deformed due to the fixed water pressure.

Operation of the waterproof microphone 10 will be explained hereinafter.

Figure 2A:
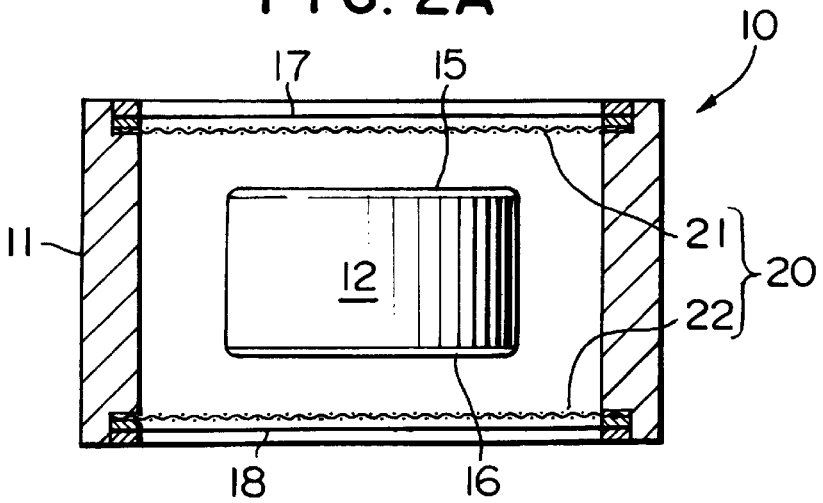
FIGS. 2A and 2B are respectively schematic sectional views showing the function of a control means of the waterproof microphone shown in FIG. 1.

As shown in FIG. 2A, in the waterproof microphone 10, when in normal use, the waterproof films 17, 18 are in the state parallel with the stainless steel meshes 21, 22.

At this time, since the stainless steel meshes 21, 22 operate as a diaphragm having a low acoustic impedance, they affect various properties of the waterproof microphone 10 less.

Figure 2B:
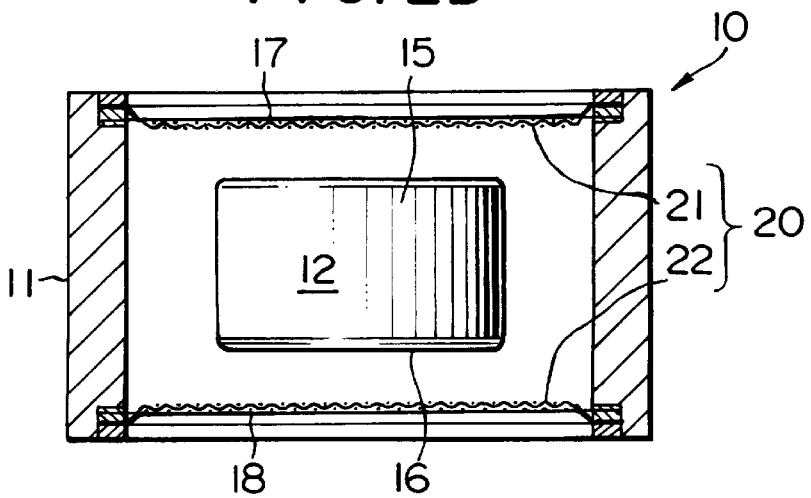

On the other hand, for example, a user drops waterproof microphone 10 into water, the waterproof films 17, 18 are deformed, as shown in FIG. 2B and come in close contact with the stainless steel meshes 21, 22.

Accordingly, even if water pressure acting on the waterproof films 17, 18 increases, the waterproof films 17, 18 are controlled in their deformation by the stainless steel meshes 21, 22 and are not likely broken.

When the waterproof films 17, 18 come in close contact with the stainless steel meshes 21, 22, the waterproof films 17, 18 are formed into a number of diaphragms divided into a small area, the waterproof microphone 10 can absorb sound in water, also.

As described above, according to the waterproof microphone 10 of the present embodiment, since the deformation of the waterproof films 17, 18 is controlled uniformly by the control means 20, even if the thickness, shape and the like of the waterproof films 17, 18 are suitably set, there is less possibility that rupture or the like caused by water pressure occurs.

Accordingly, according to the waterproof microphone 10 in the present embodiment, various properties such as the sensitivity, frequency responsiveness or the like can be enhanced as compared with the conventional waterproof microphone.

Further, since the control means 20 comprises the meshes 21, 22, in normal use of the waterproof microphone 10, the meshes 21, 22 operate as a diaphragm having a low acoustic impedance not to impede various properties.

The meshes 21, 22 are formed into a number of small diaphragms due to the close contact of the waterproof films 17, 18 in water, and the waterproof microphone 10 can absorb sound in water.

It is to be noted that the present invention is not limited to the aforementioned embodiment but improvements, modifications and the like within the scope of accomplishment of the present invention are included in the present invention.

For example, the meshes illustrated as the control means may be metal other than stainless steel or may have adequate elasticity such as synthetic resins. If the meshes have the elasticity, the sound quality when absorbing sound in water can be improved.

Further, the control means is not limited to the meshes but there can be employed the construction in which for example, a suitable rod-like member is arranged parallel with the waterproof film to thereby control the deformation of the waterproof film.

For others, the material, shape, dimension, form, number, arranging places or the like of the waterproof film, control means, meshes and the like shown in the aforementioned embodiment are suitable and not limited as long as they can accomplish the present invention.

We claim:

1. A waterproof microphone including a case;

an acoustic terminal unit having a front acoustic terminal and a rear acoustic terminal held within said case by a unit holder and a unit case;

waterproof films in said case for covering the front and rear acoustic terminals of the acoustic terminal unit, said waterproof films being deformable at a predetermined water pressure; and a restraining means provided between each of said front acoustic terminal, said rear acoustic terminal and said waterproof films for restraining the deformation of said waterproof films.

2. A waterproof microphone according to claim 1, wherein said restraining mean operate as a diaphragm with lower acoustic impedance.

3. A waterproof microphone according to claim 1, wherein said restraining means operate as a plurality of small diaphragms, when said waterproof films come into contact with the restraining means at said predetermined water pressure.

4. A waterproof microphone according to claim 1, wherein said restraining mean comprise meshes arranged parallel with each of said waterproof films.

5. A waterproof microphone according to claim 2, wherein said restraining mean comprise meshes arranged parallel with each of said waterproof films.

6. A waterproof microphone according to claim 3, wherein said restraining mean comprise meshes arranged parallel with each of said waterproof films.

7. A waterproof microphone according to claim 1, wherein said restraining means comprise pole members arranged parallel with each of said waterproof films.

8. A waterproof microphone according to claim 2, wherein said restraining means comprise pole members arranged parallel with each of said waterproof films.

9. A waterproof microphone according to claim 3, wherein said restraining means comprise pole members arranged parallel with each of said waterproof films.

10. A waterproof microphone according to claim 1, wherein said waterproof films are formed in a predetermined shape by polyethylene terephthalate.

11. A waterproof microphone according to claim 2, wherein said waterproof films are formed in a predetermined shape by polyethylene terephthalate.

12. A waterproof microphone according to claim 3, wherein said waterproof films are formed in a predetermined shape by polyethylene terephthalate.

* * * * *